United States Patent [19]

Karliner et al.

[11] Patent Number: 4,511,427

[45] Date of Patent: Apr. 16, 1985

[54] MASKING TAPE APPLICATOR

[75] Inventors: Rudy R. Karliner, Minnetonka; Gerald E. Peterson, St. Paul, both of Minn.

[73] Assignee: Wagner Spray Tech Corporation, Minneapolis, Minn.

[21] Appl. No.: 522,972

[22] Filed: Aug. 15, 1983

[51] Int. Cl.[3] ..... B32B 35/00

[52] U.S. Cl. ..... 156/523; 156/577; 156/579

[58] Field of Search ..... 156/523, 526, 527, 577, 156/579

[56] References Cited

U.S. PATENT DOCUMENTS

| | | | |
|---|---|---|---|
| 2,809,761 | 10/1957 | Delbert | 156/527 |
| 2,926,807 | 3/1960 | Park | 156/526 |
| 3,051,223 | 8/1962 | Waltz | 156/527 |
| 3,308,002 | 3/1967 | Hurwich et al. | 156/577 |
| 3,374,139 | 3/1968 | Fritzinger | 156/523 |

*Primary Examiner*—Michael Wityshyn

*Attorney, Agent, or Firm*—Hill, Van Santen, Steadman & Simpson

[57] ABSTRACT

A hand held tape dispenser and applicator having a light weight plastics material housing with a hollow hub at one end mounting an exposed roll of pressure sensitive adhesive tape and a hand grasped hollow finger extending from the hub to a dispensing outlet where a feed roll receives the adhesive foil of the tape and directs the opposite face to a press roll for applying the tape to a surface. A thumb operated slidable trigger on the top of the finger selectively rocks a cutter head over the press roll to sever the dispensed tape. The housing is longitudinally split with the two mating components snap fitted together and easily pulled apart to insert the tape roll and thread the tape over the feed roll. A belt clip receives the hollow hub permitting the applicator to be releasably suspended from the waist belt of a user.

12 Claims, 16 Drawing Figures

FIG. 6
FIG. 5
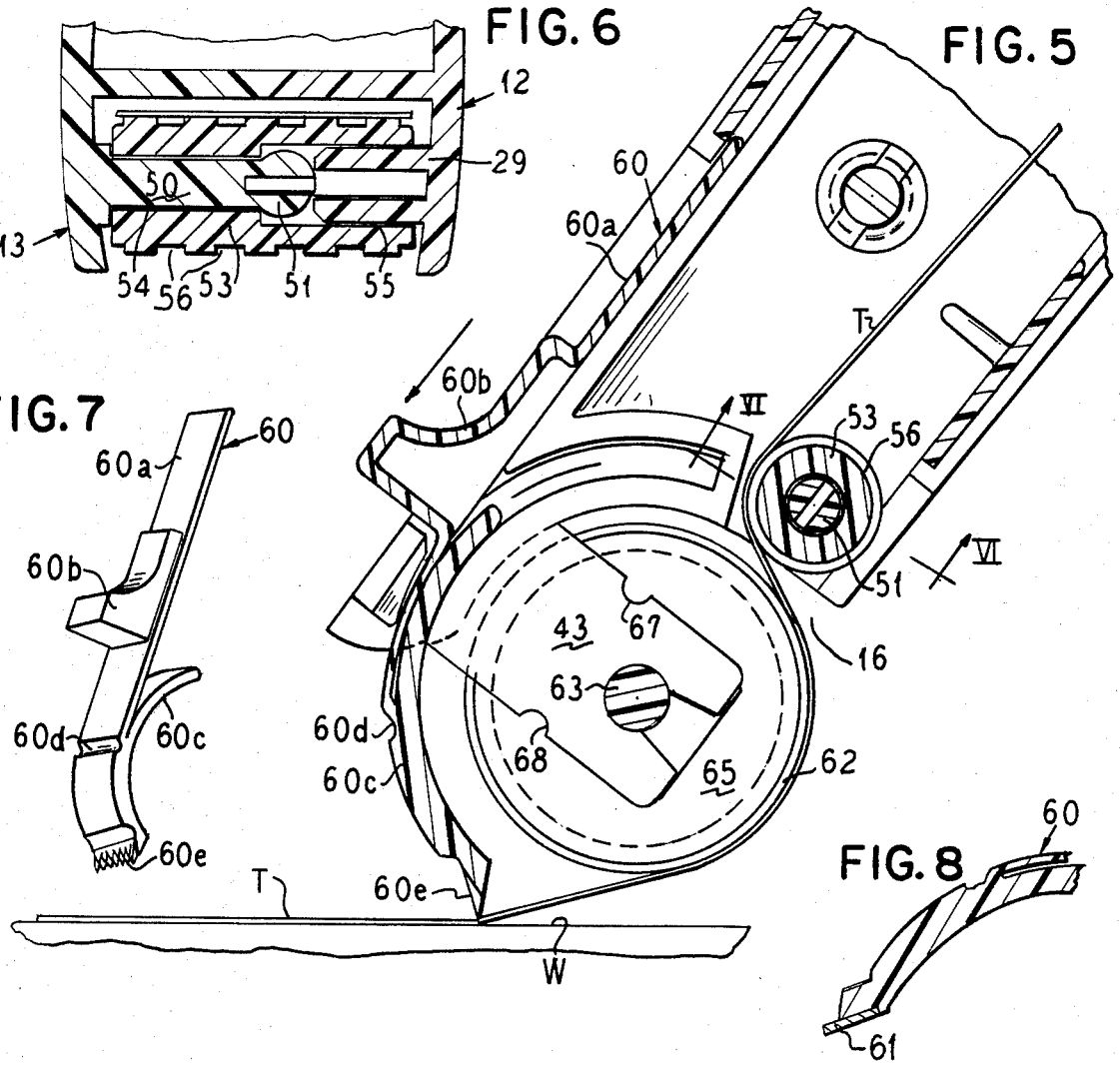
FIG. 7
FIG. 8
FIG. 11
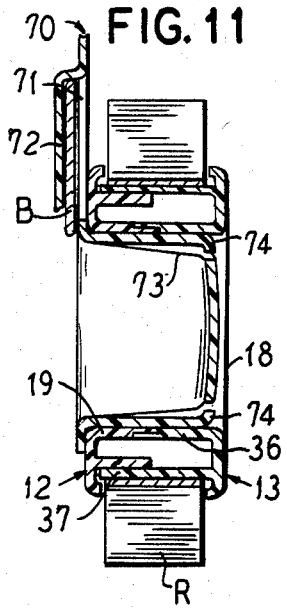
FIG. 10
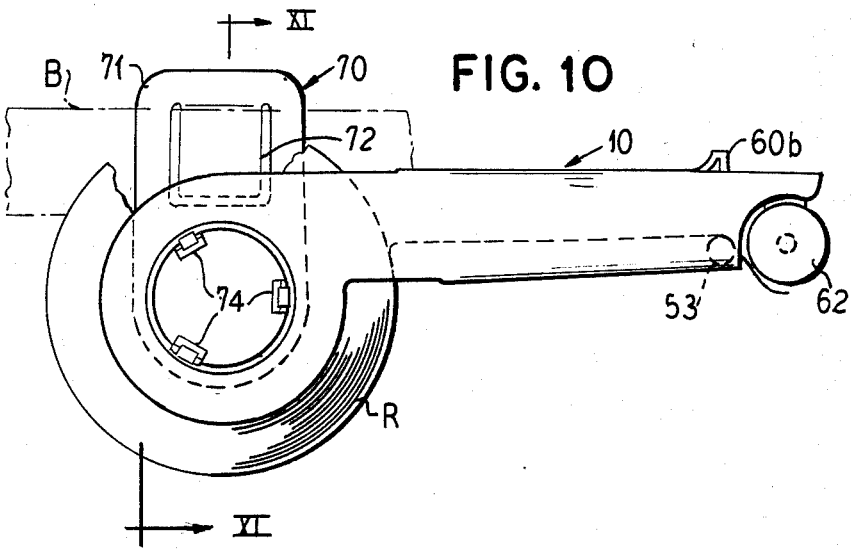

MASKING TAPE APPLICATOR

BACKGROUND OF THE INVENTION

1. Field of the Invention

This invention relates to the art of tape dispensers and applicators and specifically deals with lightweight hand held tape dispensers which feed and apply masking tape to the surface.

2. Background of the Invention

Conventional dispensers for pressure sensitive adhesive tapes do not feed and press the tape against the surface to which it is to be applied and have fixed cutters in advance of the dispensing outlet which interfere with the application of the tape to the surface. Such dispensers are not adapted to be worn by the user and most frequently are discarded after a roll of tape carried thereby is exhausted.

It would therefore be an improvement in this art to provide a hand held tape dispenser which also applies the tape, can be easily opened and closed for replacement of tape rolls, applies the tape under pressure, severs the applied tape and is adapted to be worn by the user.

SUMMARY OF THE INVENTION

According to this invention there is provided a hand held tape dispenser and applicator having a longitudinally split elongated plastics material housing with mating halves that are easily opened up and snapped together to define at one end a hub for receiving an exposed roll of tape and a hand grasped hollow finger extruding from the hub to a dispensing outlet having guide and press roll supports. A roll of tape snugly fits around the hub with the wound tape exposed and extending beyond the housing. A guide or feed roll rotatably mounted on its support receives the adhesive side of the tape providing for a taut run of the tape through the fingers between the tape roll and the outlet. A press roll rotatably mounted on its support in the outlet receives thereunder the non-adhesive side of the tape. The mated together housing halves also define a trigger and cutter head track with an exposed top window. A thumb engaged trigger is slidably mounted on the track to lock an arcuate cutter head portion in the track with a front end movable into the dispensing outlet overlying the press roll. The cutter head has a knife edge for severing the tape beyond the press roll.

The arrangement is such that the press roll presses the tape against a surface to be covered, the feed roll feeds the tape to the press roll as the applicator is manually advanced over the surface when the cutter head is retracted and then when the applicator reaches the end of the surface to be covered, the trigger is pushed forward to engage the knife edge with the tape whereupon a lifting or twisting of the housing will sever the tape leaving a leading edge held by the feed roll under the press roll with a taut run of the tape between the press roll and tape roll.

The applicator is conveniently worn by the user when not in use by a belt clip fitting the hub portion of the housing.

The housing defines a conveniently grasped finger between the tape roll and the dispensing outlet.

The press roll is preferably in the form of a dumbbell with a center axle snap fitted into the housing support and with a cylindrical cap filling the gap between the sides of the roll. The roller ends are preferably covered with elastomeric ties which grip the tape.

The entire applicator housing parts, the rollers, the trigger and cutter head and snap fit retainers are formed of lightweight, inexpensive plastics materiai. If desired, however, the knife end of the cutter head can be formed of metal.

It is then an object of this invention to provide a hand held tape applicator which mounts a roll of tape, dispenses tape from the roll, presses the dispensed tape against a receiving surface, and severs the tape.

A further object of this invention is to provide a hand held masking tape dispenser adapted to be worn by the user and easily manipulated by one hand to apply a run of masking tape to a surface to be masked.

A specific object of this invention is to provide a lightweight hand held tape applicator rotably supporting an exposed roll of pressure sensitive adhesive tape at one end, dispensing the tape at the other end, pressing the tape against the surface to be covered as it is dispensed, and selectively severing the dispensed tape.

Another specific object of this invention is to provide a hand held masking tape dispenser having a housing defined by longitudinally split snapped together mating molded plastic sections supporting an exposed roll of tape at one end, having an elongated easily grasped finger extending from said one end to a dispensing mouth, a press roll in said mouth for applying the tape to a surface, and a trigger actuated cutter selectively advanced over the press roll to sever the tape in advance of the roll.

Other and further objects of this invention will be apparent to those skilled in this art from the following detailed description of the annexed sheets of drawings which show a best mode embodiment of the invention:

FIG. 5 is a somewhat enlarged fragmentary longitudinal sectional view of the dispensing end of the applicator showing the cutter head in advanced position for severing the tape;

FIG. 6 is a cross-sectional view generally along the lines VI—VI of FIG. 5;

FIG. 7 is an isometric view of the trigger and cutter head;

FIG. 8 is a fragmentary side view of a cutter head equipped with a metal knife;

FIG. 10 is a side view of the applicator mounted on a belt clip showing the manner in which the applicator may be worn by the user;

FIG. 11 is a sectional view along the line XI—XI of FIG. 10;

BRIEF DESCRIPTION OF THE PREFERRED EMBODIMENTS

Figure 1:
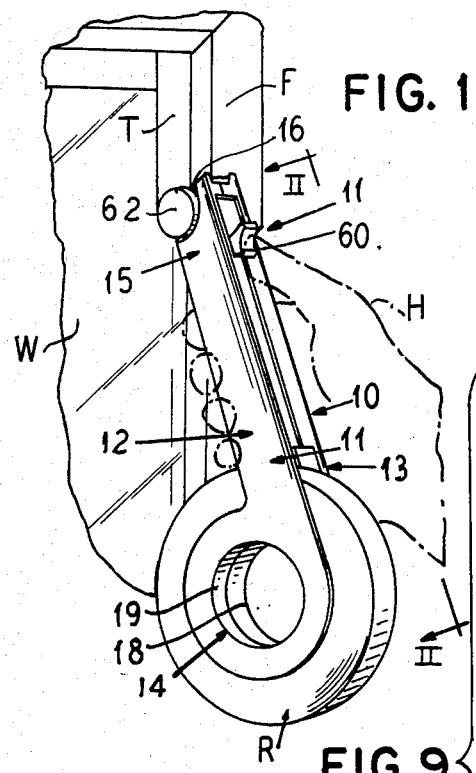
FIG. 1 is a fragmentary isometric view showing an applicator of this invention applying masking tape to a window alongside the window frame.

The applicator 10 of this invention is illustrated in FIG. 1 in a use position grasped by the hand H of a user to apply masking tape T to the side edge of a window W adjacent the window frame F for masking the window from paint to be applied to the frame. The tape T is dispensed by the applicator 10 from an exposed roll R mounted in the trailing end of the applicator.

The applicator 10 has a longitudinally split housing 11 formed from elongated mating molded plastics material half sections components 12 and 13 which are snap fitted together to provide an enlarged circular hub end 14 from which projects an elongated finger 15 conveniently grasped by the hand H and extending to an open dispensing mouth 16.

The molded housing components 12 and 13 are preferably formed from an inexpensive light-weight rigid polypropylene resin.

As shown in FIGS. 2, 3, 15 and 16, the housing component 12 has a flat sidewall 17 with a circular aperture 18 through the end 14 defined by an inturned cylindrical flange 19 with a reduced thickness inner end 19*a* to receive therearound in mated engagement therewith a corresponding portion of the opposing component 13 as hereinafter described. The sidewall at this enlarged end also has an inwardly projecting cylindrical flange 20 surrounding the flange 19 in spaced concentric relation.

A flat top wall 21 extends from the flat side wall 17 starting at the dispensing outlet end of the finger into spaced relation forwardly at the cylindrical flange 20 leaving a gap 22 therebetween. A window 23 is provided in this top wall 21 adjacent the discharge end. A track flange 24 underlies the top wall 21 extending across the window 23. This track flange 24 has a flange leg 24*a* which parallels the top wall 21 and an arcuate portion 24*b* underlying the window 23 and providing a pocket 25.

A bottom wall 26 extends from the side wall 17 with a rear end 26*a* spaced forwardly from the flange 20 leaving a gap 27 therebetween and with a front end 26*b* spaced rearwardly from the arcuate portion 24 of the track 24. A gap 28 is therefore provided between the track portion 24*b* and the front edge 26*b* of the wall 26. A hollow cylindrical axle portion 29 projects from the side wall 17 in this gap 28 for a purpose hereinafter described.

The side wall has a pair of longitudinally spaced studs 30 projecting inwardly therefrom between the top and bottom flanges or walls 21 and 26 and these studs have split ball ends 30*a* providing a snap fit connection between the component 12 and 13.

Rigidifying ribs 31 project inwardly from the side wall 17 on the bottom wall 26 and spaced parallel rigidifying ribs 32 are formed on the sidewall between the cylindrical hub 20 and the walls 30.

Figure 3:
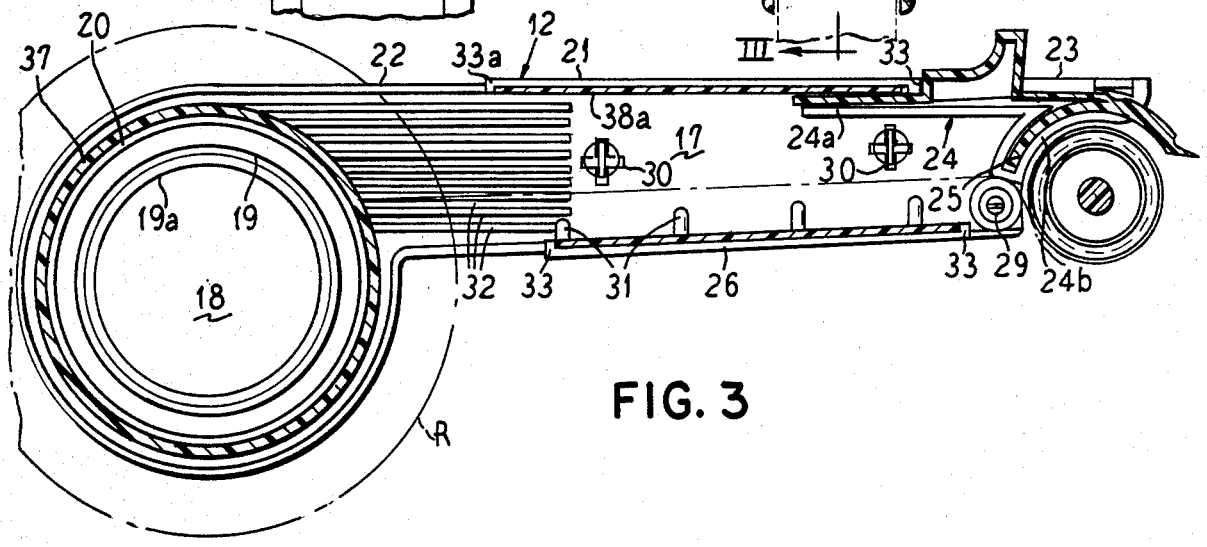
FIG. 3 is a longitudinal sectional view along the line III—III of FIG. 2.

As shown in FIG. 3, the ends of the top and bottom walls 21 and 26 are inturned at 33.

Figure 2:
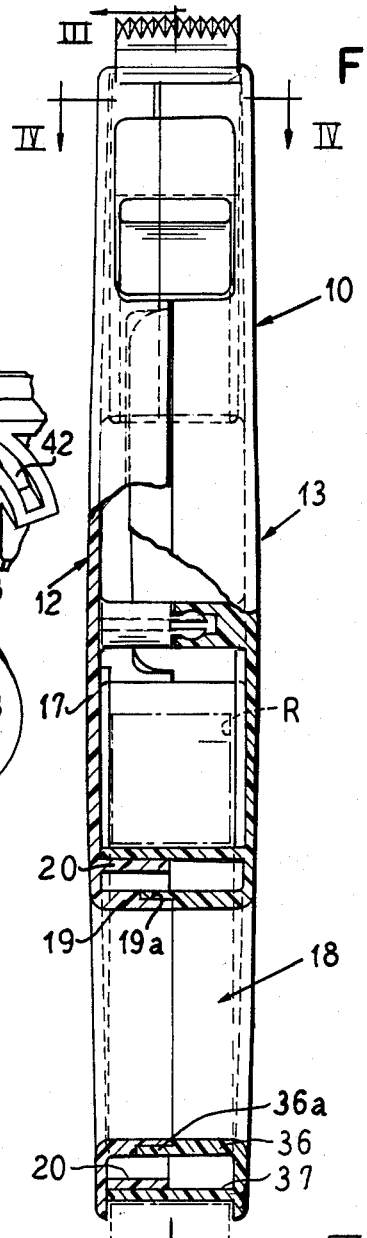
FIG. 2 is a top plan view of the applicator taken generally along the line II—II of FIG. 1 with parts broken away to show underlying portions.

As shown in FIG. 2, 12, 13 and 14, the housing component 13 has a side wall 35 with a cylindrical flange 36 surrounding the hole 18 and having a reduced thickness portion 36*a* for fitting around the reduced thickness portion 19*a* of the flange 19. The two flanges 19 and 36 therefore interfit, as shown in FIG. 2. A larger diameter flange 37 surrounds the flange 36 extending from the side wall 35 in spaced concentric relation from the flange 36 and continuing beyond the reduced thickness portion 36*a* to overlap the flange 20 of the component 12 as also shown in FIG. 2. This larger diameter cylindrical flange 37 bottoms against the rear end of the side wall 17 of the component 12 and provides the cylindrical hub support for the tape roll R.

A top wall or flange 38 extends from the side wall 35 with a rear end spaced forwardly from the flange 37 leaving a gap 39 therebetween and having a front end provided with a window 40 to mate with the window 23 of the component 12. A track flange 41 extends from the side wall 35 with a flat portion 41*a* underlying the top wall 38 and projecting under the window 40 with an arcuate portion 41*b* providing a pocket 42. The track 41 mates with the track 24 of the component 12.

A press roll support 43 depends from the front end of the arcuate track portion 41*b* at the inner edge of this track portion thus extending into the dispensing outlet 16 described above. This support is thicker than the arcuate wall 41*b* from which it depends and has a cylindrical bearing portion 44 with an open slotted bottom 45 that is tapered into the cylindrical bearing recess.

Figure 13:
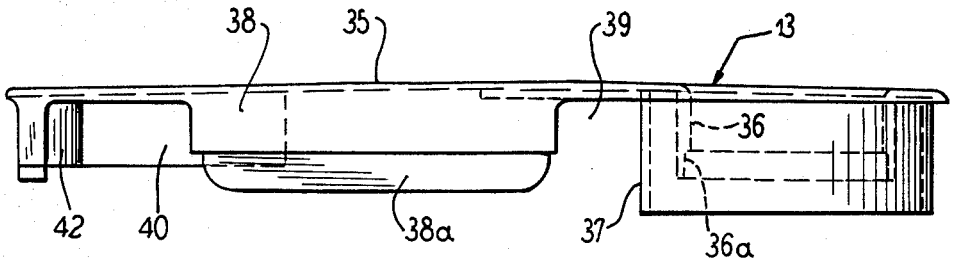
FIG. 13 is a top plan view of the housing section of FIG. 12.

As shown in FIG. 13, the top wall 30*a* has a reduced thickness tongue 38*a* projecting inwardly therefrom to fit under the top wall 21 of the component 12 between the downturned ends 33 thereof.

Figure 12:
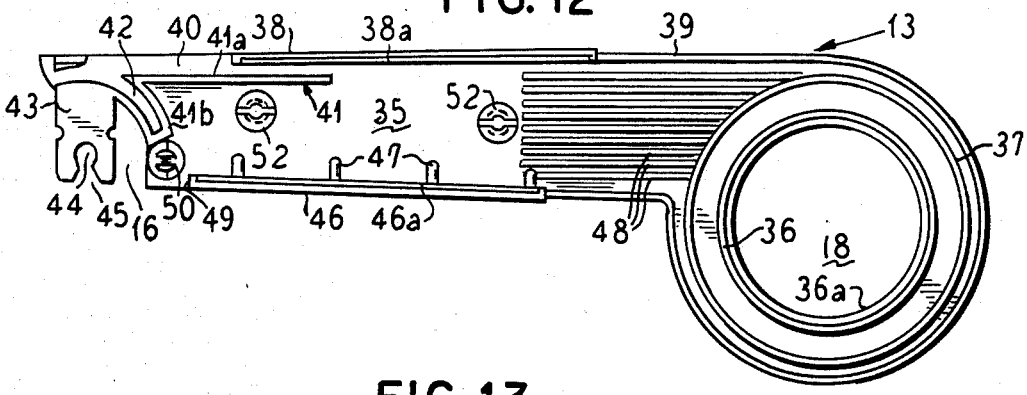
FIG. 12 is an inside longitudinal view of the housing half section to be mated with the section shown in FIG. 3.
Figure 14:
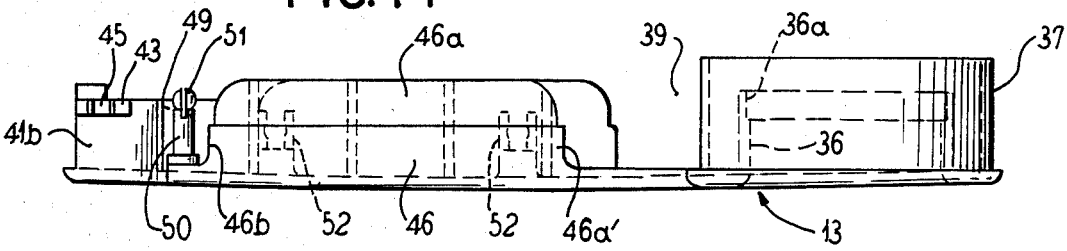
FIG. 14 is a bottom plan view of the housing section of FIG. 12.
Figure 15:
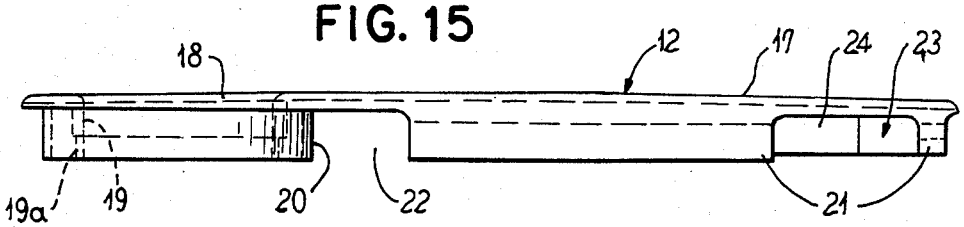
FIG. 15 is a top plan view of the housing section shown in FIG. 3.
Figure 16:
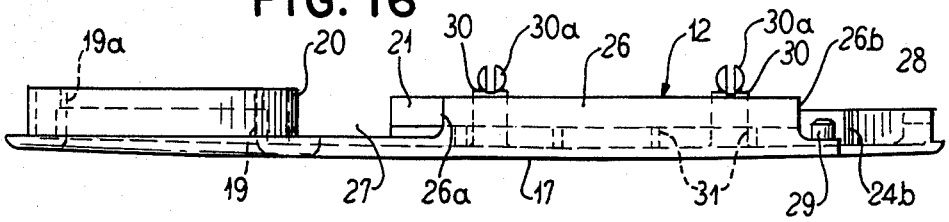
FIG. 16 is a bottom plan view of the housing section of FIG. 3.

A bottom wall 46, as shown in FIGS. 12 and 14, extends from the side wall 35 with a rear end terminating at 46*a* in spaced relation from the hub flange 37 and with a front end 46*b* spaced rearwardly behind the arcuate track portion 41*b*. A tongue 46*a* on this wall 46 interfits and mates with the bottom wall 26 of the component 12. Reinforcing ribs 47 stiffens the bottom wall 46 and longitudinal ribs 48 stiffen the sidewall 35 and the cylindrical hub portion 37.

A gap 49 between the arcuate portion 41*b* of the track 41 and the front end of the bottom wall 46 has a split cylindrical axle 50 extending from the side wall 35. The axle 50 as shown in FIG. 14 has a ball end 51. A split socket 52 projects inwardly from the side wall 35.

The components 12 and 13 mate together with the split ball ends 30*a* of the studs 30 on the component 12 snapping into the split ball recesses 52 of the component 13 and with the reduced thickness portions 19*a* and 36*a* of the cylindrical flanges overlapped and interfitted as shown in FIG. 2. In the assembled condition, the track portions 24 of the component 12 and 41 of the component 13 abut together in side-by-side relation.

As shown in FIGS. 5 and 6, a feed roller 53 has a reduced diameter bore portion 54 rotatably mounted around the axle or shaft portion 50 of the component 13. The roller 53 is snapped over the head 51 of the shaft 50 and the bore 54 is small enough to retain the roller 53 on the shaft so that the roller will be rotatably retained in the component 13. The cylindrical shaft portion 29 of the component 12 projects into a larger diameter counterbore 55 of the roller 53 and abuts the head 51 providing additional support for the roller but accomodating removal of the component from the roller.

The roller is provided with circumferential grooves 56 and is preferably formed from a resin such as nylon.

A trigger 60, as shown in FIG. 7, has a flat, relatively thin slide portion 60*a* with a raised intermediate thumb engagement portion 60*b* and a dependent arcuate cutter head portion 60*c* at the front end thereof connected thereto at a reduced thickness groove portion 60*d* to permit flexing of the arcuate portion 60*c* relative to the flat strip portion 60*a*. The leading end of the cutter head portion 60*c* is serrated at 60*e* to provide a sharp pointed cutter tip.

As shown in FIG. 5, the flat strip portion 60*a* of the trigger 60 is slidably supported on the flat track portions 24 and 41 of the components 12 and 13 with the thumb portion 60*b* projecting freely through the pocket provided by the components and with the arcuate cutter head portions 60*c* slidably mounted in the pocket provided by the tracks.

In a modified arrangement shown in FIG. 8, the trigger 60 can have a steel blade 61 secured to the forward end thereof in place of the serrations 60*e* to provide a sharp knife edge for the cutter.

Figure 9:
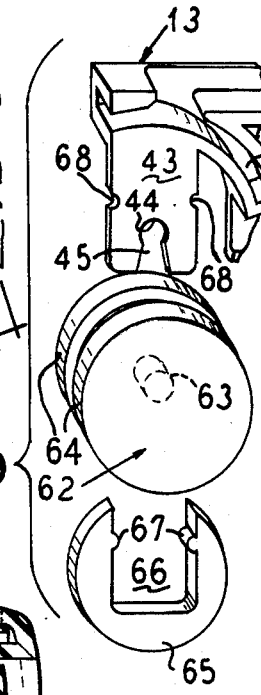
FIG. 9 is an exploded isometric view of the press roll support, cap, and press roll components of the applicator.

As shown in FIG. 9, a dumbbell press roll 62 has a central axle 63 between end wheel portions 64 and this axle snap fits into the bearing recessed 44 of the support 43. A cylindrical filler cap 65 fits snuggly between the end wheels 64 of the press roll 62 and has a rectangular recess 66 slidably receiving the support 63 with inwardly projecting bead 67 fitting notches 68 in the support 43.

Figure 4:
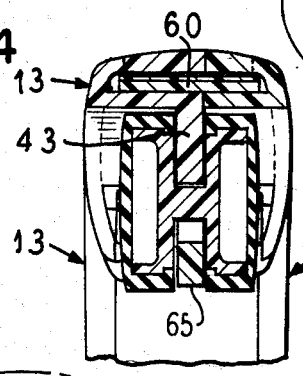
FIG. 4 is a transverse sectional view along the line IV—IV of FIG. 2.

As shown in FIG. 4, the end wheels 64 of the dumbbell press roll receive rubber tire cap 60*a*. The press roll 62 is preferably formed of a polycarbonite resin while the wheel covers or tires are preferably formed of thermalplastic rubber. Tape T from the roll R has adhesive face wrapped over the feed roll 53 and the non-adhesive face lapped under the press roll 62. The tape is dispensed through the front end outlet 60 by pressing the roll 62 against the surface to be covered as illustrated in FIG. 1 and the applicator is then advanced along the surface with the press roll pulling the tape over the feed roll 53 and rolling it onto the surface, such as the window W. During the applying step, the trigger 60 is retracted to the back of the window as illustrated in FIG. 1 so as not to interfere with the function of the press roll in riding over the tape to squeeze it against the window W. At the end of the surface to be covered, the trigger 60 is pushed forward to the position shown in FIG. 5 whereupon the cutter head 60*c* is rocked out of its retracted position in the pocket of the track to overlie the press roll 62 and press the cutter edge 60*e* against the tape on the surface. Then a rocking of the roll will cause the cutter knife to sever the tape. However, a leading marginal end of the tape will be available to underlie the press roll for the next application.

Since the adhesive side of the tape is wrapped around the feed roll 53 a taut run of the tape will be maintained between the roller R and this feed roll.

From the above description, it should therefore be understood that the housing 11 can be easily pulled apart to separate its two components 12 and 13, exposing the interior of the component 13 to receive the tape roll R around the hub 37 and to wrap the adhesive face of the leading end of the tape around the feed roll 53. This feed roll 53 is retained on the axle portion 50 of the component 13 by the head 51 as explained above. A leading portion of the tape beyond the feed roll is pulled under the press roll which is also retained in the component 13 on the support 43. Then the cover component 12 is snap fitted onto the component 13 with tongues 38*a* and 46*a* underlying the wall 21 and 26 of the cover component and with the hub portion 19*a* of the cover component fitting the hub portion 36 of the component 13. The axle portion 29 of the cover component 21 fits in the bore portion 55 of the roller 53. The split head 30*a* of the fastener studs 30 snap into the split recess 52.

The applicator 10 is conveniently carried from a waist belt B user by means of a clip 70 of this invention. This clip 70 can be made of metal or plastic material and have a back wall 71 from which is lanced a spring clip 72 to snap over the belt B. A forwardly projecting cylindrical dome portion 73 has lanced spring fingers 74 circumferentially spaced around the dome. Three such fingers are illustrated. The dome portion 73 is sized to fit in the hole 18 provided by the cylindrical flange member 19 and 36. The applicator is easily pushed onto and pulled off of the dome portion 73 and the user can wear the component between uses of the applicator.

Although the teachings of our invention have herein been discussed with reference to specific theories and embodiments, it is to be understood that these are by way of illustration only and that others may wish to utilize our invention in different designs or applications.

We claim as our invention:

1. A hand held tape dispenser and applicator which comprises a hollow housing having a tape roll receiving hub at one end, a hand grasped finger extending from said one end, and a dispensing outlet at the end of the finger, a feed roll rotatably mounting in the housing adjacent the outlet, a press roll rotatably mounted in the housing at the outlet, a trigger slidably mounted in the housing having a cutter head adapted to be projected over the press roll for severing a length of tape, and said feed roll adapted to receive therearound the adhesive face of tape from a roll mounted on the hub to direct a non-adhesive face of the tape under the press roll whereby the tape between the press roll and the surface to be taped will be pulled over the feed roll and applied to the surface as the applicator is advanced over the surface, and whereby the trigger is adapted to be propelled to press the cutter against the tape for severing the applied length of tape, said trigger having a flat slide, said cutter head tilts on said slide, and said housing has tracks receiving the slide and cutter head.

2. The applicator of claim 1 wherein the housing has a press roll support depending into the outlet, the press roll has end wheels spanning the support, and a cap on the support fills the gap between the wheels.

3. The applicator of claim 2 wherein the press roll support has a bearing aperture with an entrance gap, the press roll has an axle adapted to be pressed through the gap into the aperture, and the end wheels and support have adjoining side faces.

4. The applicator of claim 2 wherein the cap and support have interfitting heads and notches to suspend the cap.

5. A hand held tape applicator which comprises a longitudinally split elongated housing having a tape roll receiving hub at one end, an elongated hand grasped finger extending from said one end and a dispensing outlet at the end of the finger, a press roll rotatably mounted in the dispensing outlet of the housing, a feed roll rotatably mounted in the housing adjacent the press roll to direct tape to the press roll, a cutter slidably mounted in said housing adapted to be projected against the tape beyond the press roll for cutting the tape, said split housing having first and second mating components adapted to be snapped together and pulled apart for access to the interior of the housing, and said cutter including an arcuate head with a knife edge and a slidably trigger tiltably supporting the head.

6. The applicator of claim 5 wherein the press roll is shaped like a dumbbell and a cylindrical cap fills the gap between the ends thereof.

7. The applicator of claim 5 wherein the trigger and head are a one-piece molded plastic component.

8. The applicator of claim 7 wherein the hub is hollow and a carrier detachably receives the hub therearound.

9. The applicator of claim 8 wherein the carrier is a belt clip with a dome portion receiving the hub.

10. The applicator of claim 9 wherein the dome portion has spring fingers retaining the hub.

11. A hand held tape dispenser and applicator which comprises a hollow housing having a tape roll receiving hub at one end, a hand grasped finger extending from said one end, and an open front and open bottom dispensing outlet at the end of the finger, a feed roll rotatably mounted in the housing adjacent the outlet, a press roll rotatably mounted in the housing at the outlet and projecting beyond the open front and open bottom of the outlet, and a trigger slidably mounted in the housing having a cutter head movable from a retracted position leaving the press roll exposed to a projected position covering the open front of the dispensing outlet closely adjacent the press roll for severing a dispensed length of tape close to the press roll at the open bottom of the outlet, said feed roll being adapted to receive therearound the adhesive face of tape from a roll mounted on the hub to direct the opposite face of tape onto the press roll whereby the tape between the press roll and the surface to be taped will be pulled over the feed roll and applied to the surface as the applicator is applied over the surface and whereby the length of tape applied to the surface is severed as the press roll is lifted above the surface forcing the cutter head through the tape closely adjacent the press roll.

12. A hand held masking tape dispenser and applicator which comprises a longitudinally split plastics material housing having mating first and second parts and cooperating snap retainers on the parts to releasably hold the parts in fixed side-by-side mated together relation, means on said parts cooperating to define a flanged hub on one end of the housing for rotatably mounting an exposed roll of masking tape, said hub having an open faced aperture therethrough adapted to receive a carrier worn by a user for suspending the dispenser, said housing having an open front and open bottom dispensing outlet, a press roll rotatably mounted in said outlet of the housing and projecting beyond the open front and open bottom thereof, said press roll receiving masking tape from a tape roll carried on the hub around the projecting bottom portion thereof, a feed roll rotatably mounted in the housing closely adjacent the press roll wrapping the tape around the bottom of the press roll, and a slidable trigger carried by the housing having a cutter head adapted to be rocked from a retracted position over the press roll to a cutting position around the front of the press roll to sever an applied length of tape close to the press roll.

* * * * *